United States Patent [19]

Miaskoff et al.

[11] 4,078,784

[45] Mar. 14, 1978

[54] SIGNATURE OPENING APPARATUS

[75] Inventors: Leonard Miaskoff, Easton; Henry R. Mebus, Nazareth, both of Pa.

[73] Assignee: Harris Corporation, Cleveland, Ohio

[21] Appl. No.: 730,432

[22] Filed: Oct. 7, 1976

[51] Int. Cl.[2] ..... B65H 43/02

[52] U.S. Cl. ..... 270/56; 271/263

[58] Field of Search ..... 270/54–57; 271/38, 153, 110–111, 258, 262, 265, 263, 259–260; 101/246–247

[56] References Cited

U.S. PATENT DOCUMENTS

| | | | |
|---|---|---|---|
| 2,643,113 | 6/1953 | Williams | 270/56 |
| 3,169,476 | 2/1965 | Fielding | 101/247 |

*Primary Examiner*—Edgar S. Burr
*Assistant Examiner*—A. Heinz

[57] ABSTRACT

An improved signature handling apparatus includes a movable gripper jaw which operates in conjunction with similar gripper mechanisms to clamp and spread the signature so that the laps fall on opposite sides of the saddle in a saddle gatherer. In order to assure that the pages on the opposite sides of the fold fall on the appropriate side of the saddle gatherer, a sensing means is utilized to detect whether all of the pages on one side of the signature are properly clamped by the gripper jaw. Since the position of the gripper jaw is indicative of whether the correct thickness has been clamped, the sensing means emits a positive response when the gripper jaw is in the correct position. The sensing means includes a part operatively associated with the gripper jaw which is adjusted by connecting means to be in a predetermined position when the gripper jaw properly clamps the signature leg. Depending on the embodiment, the operatively associated part has either a reflecting surface or an aperture, as means for sensing its position. The sensing means further includes a light source and light sensor whereby light is received into the light sensor after either being reflected from the reflecting surface or passing through the aperture depending on the embodiment, only when the operatively associated part is in the predetermined position. Upon receiving light from the light source, the light sensor emits an electrical impulse indicating that the signature lap has been properly clamped.

9 Claims, 6 Drawing Figures

SIGNATURE OPENING APPARATUS

BACKGROUND OF THE INVENTION

The present invention relates to a caliper or sensing device for sensing the thickness of a signature being conveyed by a gripper mechanism and in particular to such a caliper for use in a signature handling apparatus for the assembly of signatures into various book forms. The invention is particularly adaptable to the operation where the signatures are opened into an inverted "V" shape for placement on a saddle gatherer prior to binding. The signatures, which in the simplest form are single sheets of paper folded in the middle so as to constitute four page surfaces and range to 16 sheets with 64 page surfaces, leave the folding operation with the page surfaces on the opposite sides of the center fold in contact. Before the pages can be bound, the halves, or laps, on the opposite sides of the fold must be spread so that the signatures can be assembled together and the folds of the signatures can be stapled or stitched.

The present invention was developed for use with a signature opener utilizing rotating drums but its use is not restricted to devices having rotating drums. A signature opener mechanism having rotating drums is described in U.S. Pat. No. 3,809,384. In brief, as the folded signature leaves a main drum it descends open end first between two drums, each of which clamp one half of the signature by means of vacuum and/or mechanical grippers. As the drums rotate in opposite directions, the signature laps are opened into an inverted "V" and released onto a triangular bar known as the saddle from which it is conveyed and gathered together with other signatures by a conveyor chain known as the saddle chain, and delivered to the saddle stitching machine for stapling. Machines of this general construction are known in the art as saddle gatherers or inserters.

Because improper spreading of the signature results in the loose, unbound pages, it is desirable to detect any misfeed as soon as practicable so as to avoid needless binding of defective books. Various calipering devices, such as mechanical cams, beta ray beam sensitometers and high voltage detectors, have been used in the prior art to gauge the thickness of an assembly of signatures after they have been collected on the saddle chain to detect a missing or improperly spread signature. All of these devices can be used with conventional magazines where thousands of magazines are published with the same thickness. However, in the future, innovative publishers who computerize the advertising content of their magazines so that the magazines can be custom built to the individual tastes of their readers will have magazines of varying thicknesses with various signatures contained therein. In a signature machine of the kind where individual signatures in folded form are transferred from hoppers and dropped onto a saddle where one signature is gathered on top of others to form a signature group, the proper delivery of a signature will have to be detected by single signature detection devices as the individual signatures are spread onto the saddle gatherer since it cannot be determined from the thickness of the signature group whether individual signatures of varying thicknesses have been properly spread thereon. The signature handling apparatus constructed in accordance with the present invention solves this problem as it detects the thickness of the individual signatures as they are transferred onto the saddle gatherer.

A single signature calipering device is also desirable with conventional signature gathering as it is more sensitive than a caliper which gauges a group of signatures assembled on the saddle gatherer, since as more pages are combined it is more likely variances in the thickness of paper will affect the reading. By detecting missing pages in single signatures before the signatures are grouped, this possibility of error is diminished.

SUMMARY OF THE PRESENT INVENTION

The present invention is a signature handling apparatus having a sensing means which detects the position of a gripper jaw to ascertain whether the correct thickness of paper is being clamped each time a signature is opened and placed onto the saddle gatherer. Detection of the correct position of the gripper jaw is accomplished by detecting the position of an operatively associated part which is contiguous with the gripper jaw and adjusted to be in a specific position when the gripper jaw properly engages the correct thickness of paper. When the operatively associated part is in this specific position, a beam of light is either reflected from a surface of the operatively associated part, or passes through an alignment of slots, depending on the embodiment, into a light sensor. If the gripper jaw engages the improper thickness of paper the operatively associated part is improperly positioned and no light is received by the light sensor. When the light sensor receives light an electrical impulse is transmitted to the machine control circuits. If no impulse is transmitted to the machine control circuits, the normal binding and processing operations involving the particular signature are halted.

The sensing means includes a light source which emits a narrow intense beam, a light sensor, an electronic amplifier and machine control integration circuitry, all of which are conventional and known in the prior art.

When the gripper means is mounted to a drum, a cam operated timing switch, the cam being driven by the shaft of the drum, actuates the light sensor only during the detection period. The length of the detection period, which is the extent of time that the cam closes the switch during each revolution of the drum, varies with each embodiment as will be explained in the description of the embodiments.

The system is "failsafe," or self detecting, to the extent that a signal must be received during the detection period in order for a positive response to be transmitted to the machine control circuits. If the photo electric circuit fails to function due to excessive dirt or faulty wiring, the binding operation is interrupted.

The embodiments of the present invention utilize either reflecting surfaces or aligning apertures as means for detecting whether the operatively associated part is in the correct position which corresponds to the proper clamping of a signature lap by the gripper jaw. The position of the reflecting surface is detected by a light beam which is reflected into a stationary light sensor unit at a specific point or interval in the clamping cycle. In an alternate embodiment a slot or aperture in the operatively associated part is aligned with a corresponding slot or aperture in the opener drum during an approximate 20° interval when the gripper jaw has clamped the signature lap. In either case the operatively associated part is adjustable to be in a specific position so that light from the stationary light source enters the stationary light sensor when the appropriate thickness of paper is clamped by the gripper jaw. It should be noted that if the operatively associated part proves to be impracticable as a means providing for adjustment of the detecting apparatus for various thicknesses of signature laps, the gripper jaw seat could be made adjustable in order to accommodate such thickness changes thereby eliminating the need for an operatively associated part as the reflecting surface or aperture could be positioned on the gripper jaw. Also, changes in thicknesses of the signature laps could be accommodated by making the position of the light sensor or the light source adjustable.

Further refinements in embodiments of the present invention are directed at amplifying the distinguishable difference between when the gripper jaw engages the correct thickness of paper and when an incorrect number of pages are clamped. In some embodiments, divergence between correctly reflected and incorrectly reflected light beams is amplified by using secondary reflecting surfaces. The foregoing and other features of the present invention will be apparent to those skilled in the art from the following more particular description of the preferred embodiments. Other embodiments of the present invention utilizing the same or equivalent principles may be used and structural changes may be made as desired by those skilled in the art without departing from the scope of the present invention.

DESCRIPTION OF THE EMBODIMENT

Figure 1:
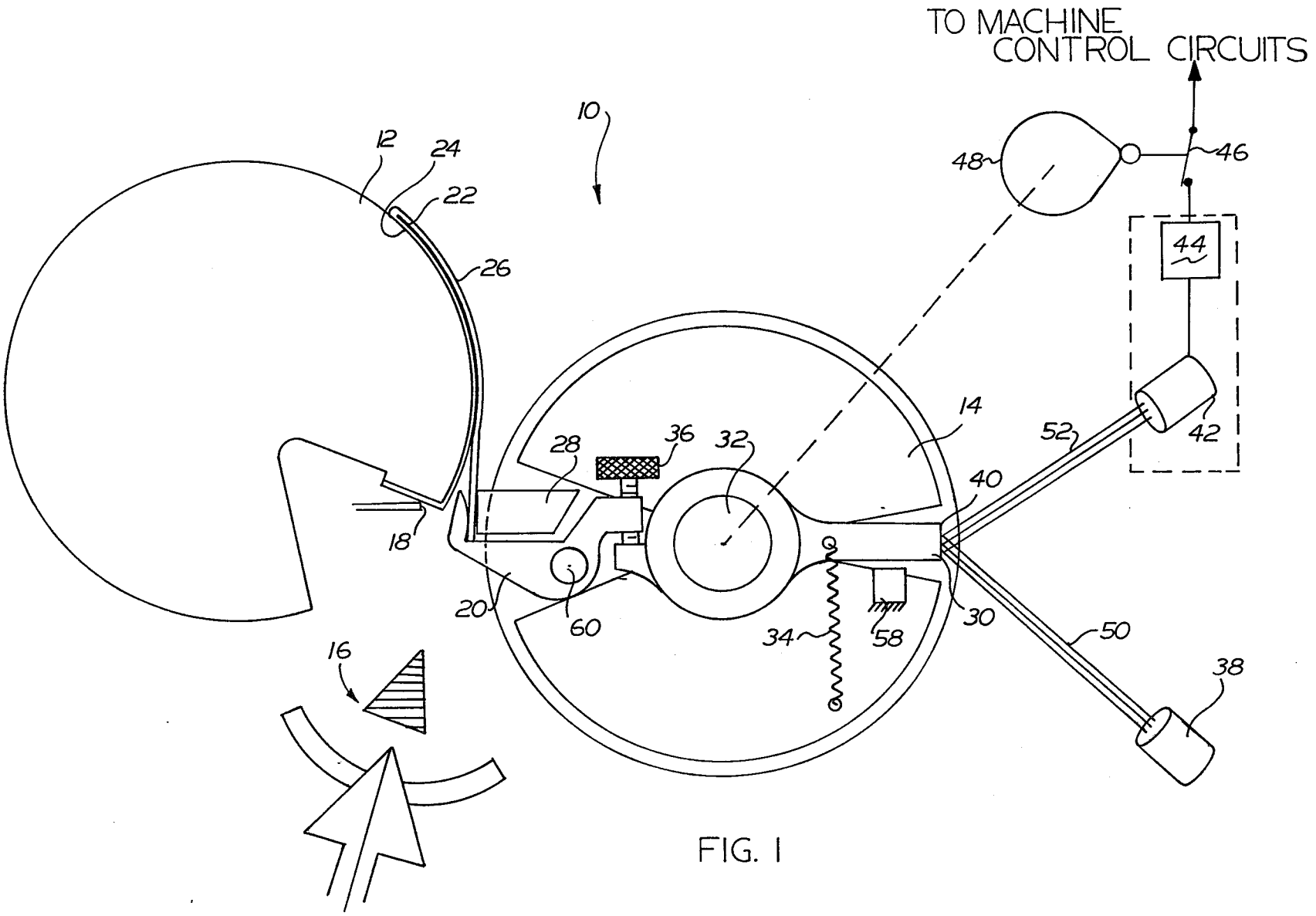
FIG. 1 is a digrammatic illustration of an embodiment of the present invention.

A signature handling apparatus 10 constructed in accordance with the present invention includes a transfer drum 12 and opener drum 14 which operate to open the folded signature 22 on to the saddle 16. The transfer of the signature onto the transfer drum 12 is explained in detail in U.S. Pat. No. 3,809,384 and will not be described herein. Due to the curvature of the transfer drum 12, the right lap 26 (as seen in FIG. 1) of the signature 22 protrudes from the periphery of the transfer drum 12 when the transfer drum gripper 18 has engaged the other lap 24. As the transfer drum 12 rotates, the protruding lap 26 enters the opening between the opener drum gripper jaw 20 and the opener drum gripper jaw seat 28 and is firmly clamped as the gripper jaw 20 turns on shaft 60 into the position shown in FIG. 1. An operatively associated part 30, which remains associated with the gripper jaw 20 during the clamping action, pivots freely on the opener drum shaft 32 and follows the movement of the gripper jaw 20 due to the biasing action of spring 34 when not disengaged by stop 58. By moving adjusting screw 36, the operatively associated part 30 is adjusted so as to be in the position shown in FIG. 1 when the gripper jaw 20 executes a proper clamping action.

When the operatively associated part 30 is in the predetermined position of FIG. 1 light beam 50 from the light source 38 is reflected by the reflecting surface 40 of the operatively associated part 30 into the path of light beam 52 which enters the light sensor 42. Upon receiving light, the light sensor 42 emits an electrical signal which is amplified by the electronic amplifier 44 and transmitted to the machine control circuits (not shown). The light source 38, light sensor 42, electric amplifier 44 and machine control circuitry are all of conventional design. The machine control circuitry is designed such that only when a signal is emitted from the light sensor 42 will the machinery continue its normal functions. The detection circuitry is self detecting of a failure by one of the components to the extent that if a component malfunctions, and no signal is transmitted, the machine control circuits will stop the processing of the signatures.

Since the light source 38 and light sensor 42 remain stationary relative to the rotating opener drum 14, the detection circuitry must be synchronized so as to operate only during a specific interval in each revolution of opener drum 12. For this reason, a cam operated timing switch 46 completes the circuits only during the detection interval. The detection period for the embodiment shown in FIG. 1 is extremely short and corresponds to the point in each revolution of the opener drum 14 when it is in the position shown. When the opener drum 14 reaches this position, a lobe in cam 48, mechanically connected to the opener drum shaft 32 so as to rotate concurrently, closes the switch 46 to complete the detection circuit which is schematically illustrated in FIG. 1.

Figure 2:
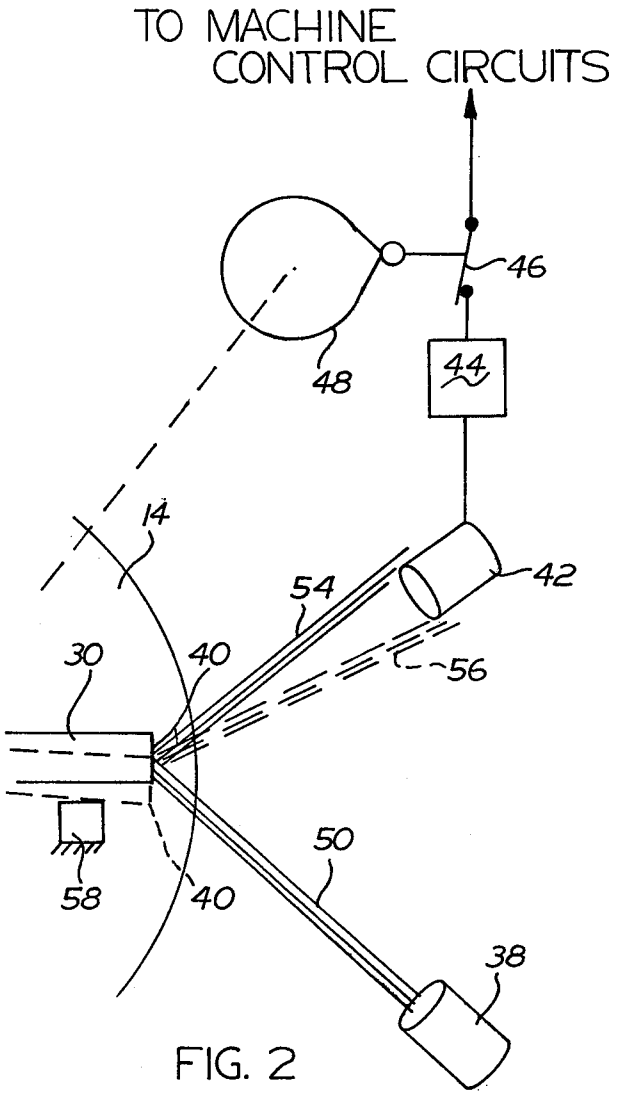
FIG. 2 is a diagrammatic illustration showing the paths of beams of light when the signature handling apparatus of FIG. 1 fails to clamp the signature lap properly.

Referring now to FIG. 2, when the gripper jaw 20 (not shown) engages an incorrect thickness of paper, the operatively associated part 30 will not be in the predetermined position of FIG. 1 and light will not be received into the light sensor 42. Assuming the gripper jaw 20 misses the lap 26 completely, or some of its pages, the reflecting surface 40 is positioned as illustrated in exaggerated fashion by the solid lines in FIG. 2 whereby the light beam 50 is reflected from the reflecting surface 40 into the path of light beam 54 which does not enter the light sensor 42. The result is that no impulse is emitted from the light sensor 42 so that the machine circuits do not receive a positive signal and the normal processing operation is interrupted for the particular publication into which the defectively spread signature is inserted. If the gripper jaw 20 clamps too many sheets of paper the result is as shown by the broken lines in FIG. 2 whereby the reflective surface 40 is positioned such that light is reflected into the path of light beam 56 and again no light is received by the light sensor 42. Once again a positive signal is not received by the machine control circuits and the processing operation is interrupted for the particular publication into which the defective signature is inserted.

Each time a signature 22 having a greater or lesser number of pages is to be transferred, the signature handling apparatus 10 must be adjusted since the gripper jaw 20, after properly engaging the signature lap 26, attains a different position relative to the opener drum 12 due to the difference in the thickness of paper being clamped. To compensate for the change in thickness, the location of the operatively associated part 30 relative to the gripper jaw 20 is changed by adjusting screw 36 so that the operatively associated part 30 is in the predetermined position when the signature lap is properly clamped allowing light from light source 38 to be reflected by reflecting surface 40 into the light sensor 42. Means for adjusting the signature handling apparatus 10 so as to respond correctly for various thicknesses of signatures without adjustment of the operatively associated arm 30 include providing a means for varying the location of seat 28 so as to accommodate the change in thickness without effecting the movement of gripper jaw 30, and in the alternative, means for varying the location of the light source 38 and light sensor 42. By adjusting the position of seat 28 to offset the change in thickness of signature lap 26, both the gripper jaw 20 and operatively associated arm 30 will attain the same position relative to the opener drum 14 when proper clamping occurs. In the alternative, the light sensor 42 or light source 38 could be repositioned so as to compensate for the relocation of the operatively associated part 30 so that the reflective surface 40 reflects light from the light source 38 into the light sensor 42 when the signature lap 26 is properly engaged.

Figure 3:
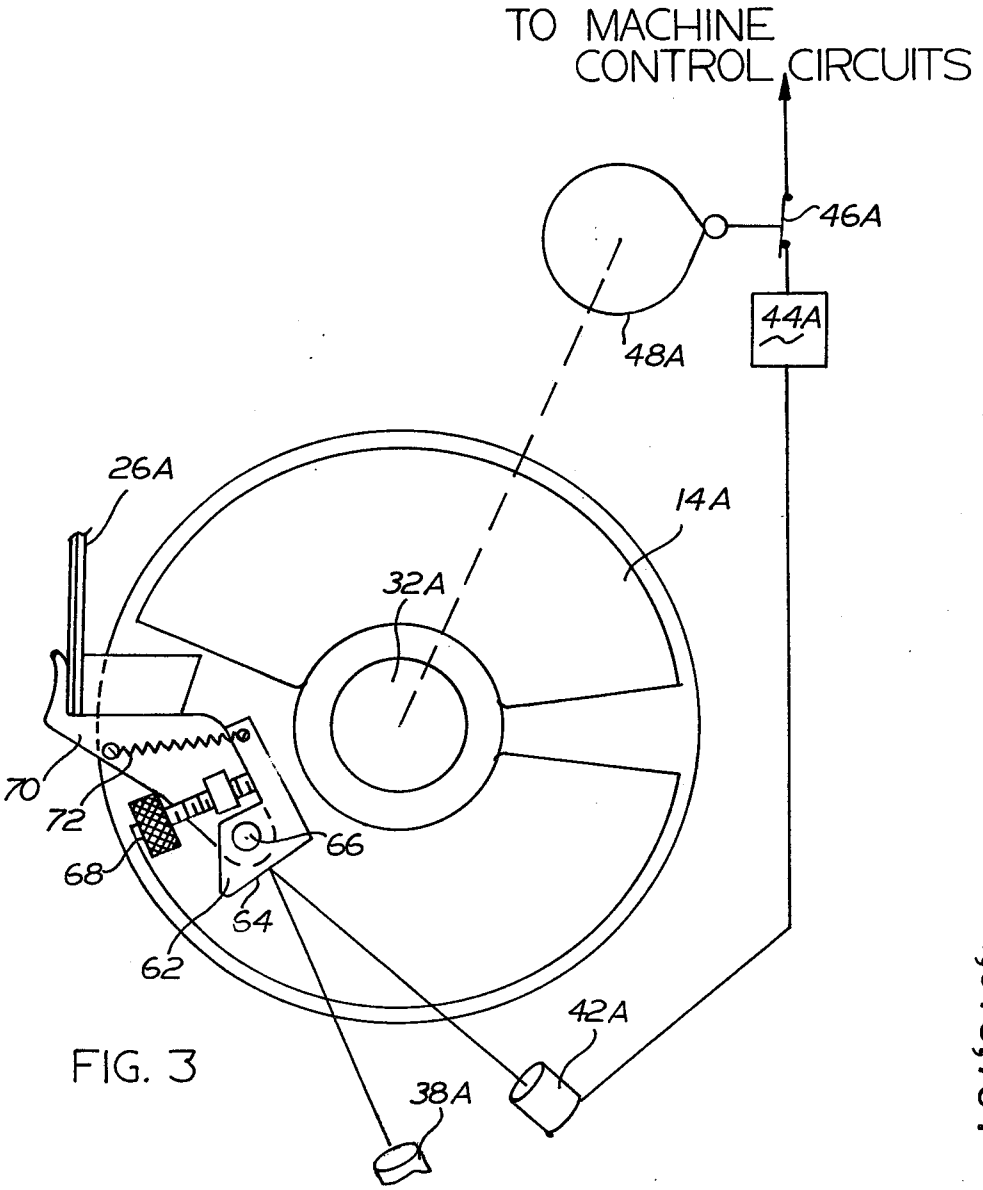
FIG. 3 is a partial diagrammatic illustration of another embodiment of the present invention.

With reference now to FIG. 3, an alternate embodiment of the present invention is illustrated wherein an operatively associated part 62 having a reflective surface 64 pivots freely on the shaft 66 and is biased against the adjusting screw 68 mounted to the gripper jaw 70 by spring 72 for contiguous movement with the gripper jaw 70. The position of the operatively associated part 62 is changed relative to the gripper jaw 70 by movement of the adjusting screw 68 such that the reflective surface 64 is in the proper position to reflect light from the light source 38A into the light sensor 42A when the signature laps 26A of various thicknesses are properly engaged by gripper jaw 70. Components identical in function to those employed in FIG. 1 have the same corresponding number with a letter suffix added. Light source 38A, light sensor 42A, electronic amplifier 44A and cam operated timing switch 46A function in the same manner as the corresponding components of the embodiment illustrated in FIG. 1.

Figure 4:
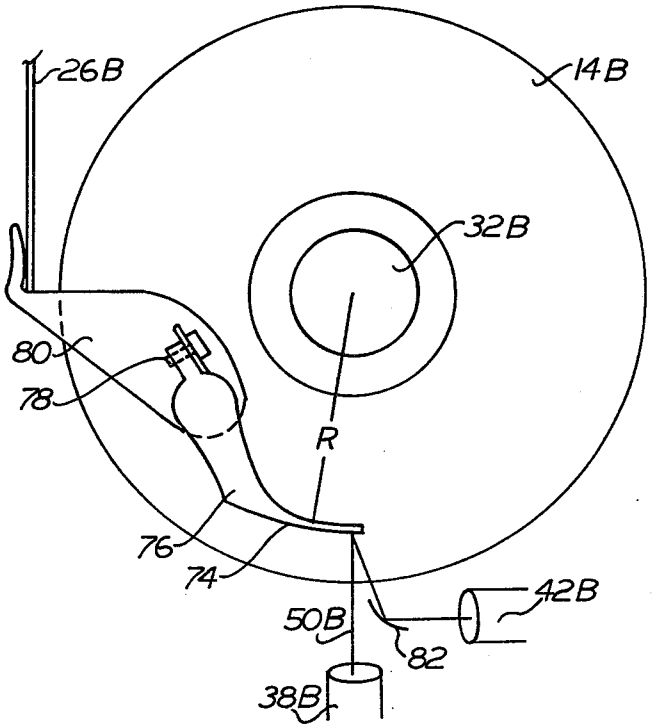
FIG. 4 is a partial diagrammatic illustration of still another embodiment of the present invention.

In FIG. 4 an embodiment of the present invention having an extended detection period is illustrated. Due to the fact that the light sources 38, 38A and the light sensors 42, 42A remain stationary while the reflecting surfaces 40, 64 rotate with the opener drums 14, 14A, the position of the reflecting surfaces 40, 64 must be detected in a precisely coordinated fraction of a second in the embodiments of FIGS. 1 and 3. A longer detection interval is provided with the embodiment illustrated in FIG. 4 due to the fact that the reflecting surface 74 on the operatively associated arm 76 is arcuate. By adjustment of adjusting screw 78, at the predetermined position corresponding to when gripper jaw 80 properly clamps signature lap 26B the operatively associated part 76 is positioned such that the center of curvature of the reflecting surface 74 coincides with the center of the opener drum shaft 32B. So long as the light beam 50B strikes the arcuate surface 74, the angle of reflection is unaffected by the rotation of the opener drum 14B when the gripper jaw properly engages the signature lap 26B. If the gripper clamps an incorrect thickness, the arcuate reflecting surface 74 will not have its center of curvature at the center of the shaft 32B and the angle of reflection changes resulting in the light sensor 42B not transmitting a "good" signal. Synchronizing means (not shown) are utilized as in the previously described embodiments to actuate the sensor only during the detection period and the signal is transmitted to the machine control circuits in the same manner as previously explained.

A slightly concaved secondary reflecting surface 82 is utilized as illustrated in FIG. 4 to compensate for beam spread resulting from the curvature of the primary reflecting surface 74. In addition, the secondary reflecting surface 82 also increases the sensitivity to changes in the thickness clamped by the gripper jaw 80 as the length of reflecting surface 82 may be such that an incorrectly reflected beam misses it.

In FIG. 4, unlike the previously described embodiments, the adjusting screw 78 is threaded into projections from both the gripper jaw 80 and the operatively associated part 76 for concurrent movement without the use of a biasing means.

Figure 5:
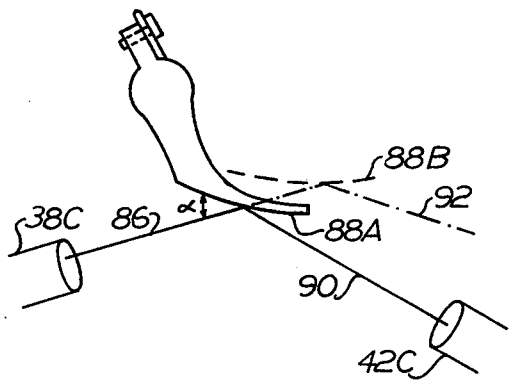
FIG. 5 is a partial diagrammatic illustration of the embodiment of FIG. 4 wherein the light source and sensor have been positioned to provide enhanced sensitivity.

Greater sensitivity to deviations in signature thickness may be realized by re-orienting the light source and sensor so that the light beam strikes the reflecting surface at a more shallow angle. Thus, as shown in FIG. 5, the embodiment of FIG. 4 may be altered to provide greater sensitivity by orienting light source 38C so as to cause the light beam 86 to strike reflecting surface 74C at a more acute angle, $\alpha$. It will be seen that a large angular deviation of light beam 86 is produced when the reflecting surface 74C undergoes a small angular change from position 88A (indicated by a solid line) to position 88B (indicated by a broken line). The light beam 86 from light source 38C is diverted from the path 86–90 to the path 86''92. Again, a secondary reflecting surface (not shown in FIG. 5) could be used, as in FIG. 4, to compensate for beam spread. Although the extreme angular divergence would not be necessary for the angular change depicted in FIG. 5, minute angular changes requiring such amplification are probable when gripping signatures having relatively thin sheets with many pages.

Figure 7:
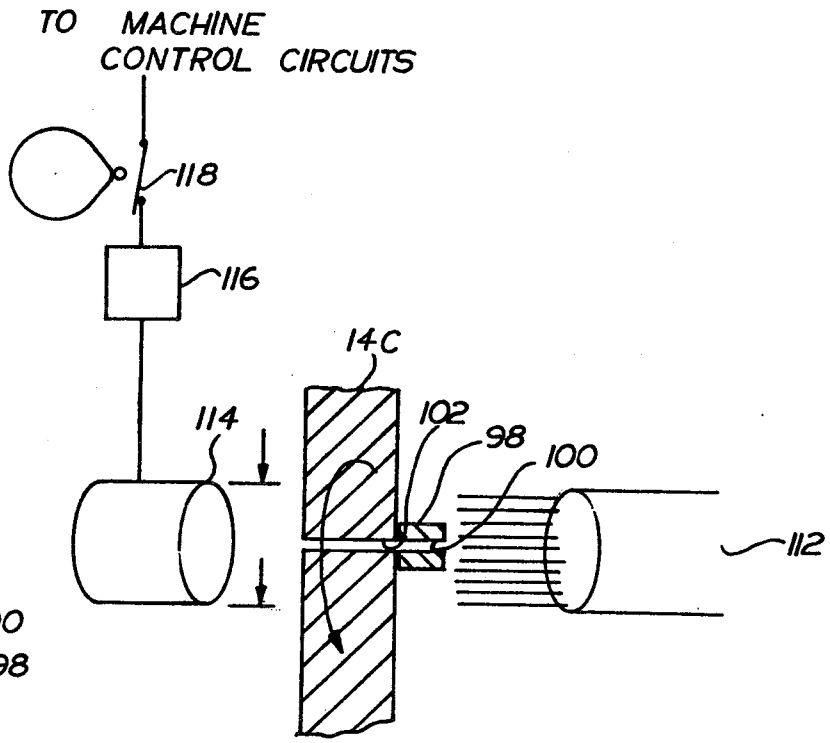
FIG. 7 is a fragmentary sectional view of a portion of the signature handling apparatus of FIG. 6.
Figure 6:
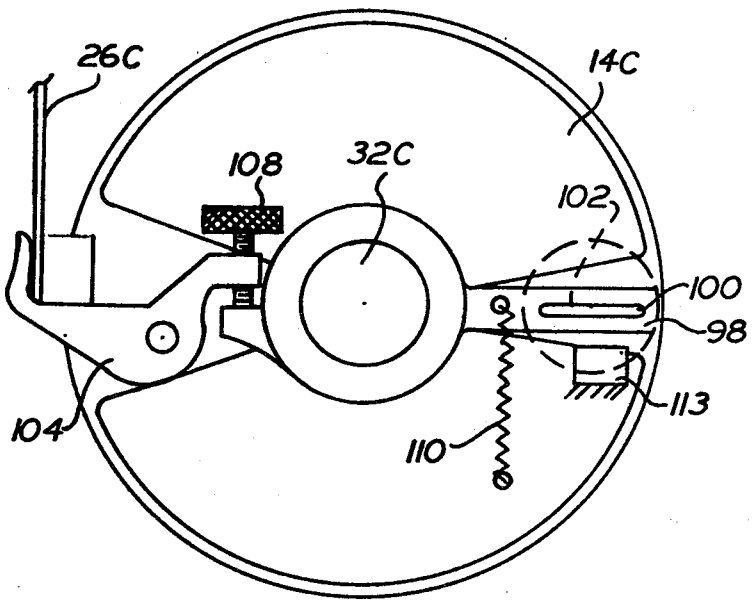
FIG. 6 is a partial diagrammatic illustration of a further embodiment of the present invention.

In the embodiment of the present invention illustrated in FIG. 6, the operatively associated part 98 pivots freely on the opener drum shaft 32C and is biased against the adjusting screw 108 mounted in gripper jaw 104 by the spring 110 when the stop 113 does not limit such movement. When the gripper jaw 104 correctly clamps the signature lap 26C, the operatively associated part 98 is positioned by the adjusting screw 108 such that the aperture 100 in the operatively associated part 98 is superimposed over the aperture 102 in the opener drum, allowing a light beam to pass through the openings. The light beam is emitted from a stationary light source 112 into a light sensor 114 having diameters indicated by the broken line circle in FIG. 6 and shown schematically in FIG. 7. Since the gripper jaw 104, having clamped the signature lap 26C, does not move relative to the opener drum 14C for approximately 20 degrees of rotation in each revolution of the opener drum 14C, the detection period extends through out this 20 degree arc since the light source 112 and light sensor 114 have diameters which allow emission and reception of light within this arc as illustrated in FIG. 7. Utilizing the conventional photo electric circuitry, schematically shown in FIG. 7 having a light sensor 114, electronic amplifier 116, and a cam operated switch 118, the light sensor 114 is activated during the detection period such that when the apertures 100, 102 are superimposed indicating that the gripper jaw 104 has correctly clamped the signature lap 26C, light emitted from light source 112 is received by the light sensor 114 and a positive signal is transmitted to the machine control circuits.

While having illustrated and described specific embodiments of the present invention, it is to be understood that the present invention is not limited to the precise constructions herein disclosed and that various changes and modifications may be made without departing from the spirit and scope of this invention. Thus, although described specifically with respect to the opening drum of a saddle gatherer, it will be appreciated that the invention will find equal utility in signature handling devices having grippers designed to grip the full thickness of the signature, rather than merely a portion thereof.

The following is claimed:

1. A signature handling apparatus comprising a rotatable drum for carrying a signature, said signature having a thickness, signature gripper means carried on said rotatable drum for rotation therewith, said gripper means comprising a pair of opposing gripper jaws which engage and clamp at least a portion of said thickness of said signature between said jaws, a gripper detection apparatus for sensing the thickness of said clamped portion, said detector apparatus including a part carried by and rotatable with said drum, said part having a first aperture and said rotatable drum having a second aperture, adjusting means connected between one of said jaws and said part for adjusting the position of said part so that said apertures are aligned when said clamped portion of said signature has a predetermined desired thickness, and means for sensing alignment of said apertures.

2. A signature handling apparatus as defined in claim 1 wherein said sensing means comprises a light source and a light sensor means for indicating the presence of light, such that when said first aperture is substantially superimposed over said second aperture light from said light source will enter said light sensor means.

3. A signature handling apparatus as defined in claim 2 wherein said drum is a revolving drum and further including a base which does not rotate relative to said drum, said sensing means further including mounting means for mounting said light source and light sensing means to said base, and synchronizing means for actuating said light sensor means only during a predetermined interval in each revolution of said drum, said predetermined interval including at least a fraction of the interval when said gripper jaws engage said at least a portion of said signature.

4. A signature handling apparatus as defined in claim 3 wherein said synchronizing means comprises a cam mechanically connected with said rotatable drum and a cam operated switch mounted on said base, said light sensor means being actuated only when said cam operated switch is closed, said cam having a lobe which operates to close said switch.

5. Apparatus for handling a signature having a thickness comprising a rotatable drum, gripper means mounted on said drum for rotation therewith, said gripper means including a pair of gripper jaws which engage and clamp at least a portion of said thickness of said signature between said jaws, means for sensing the thickness of said clamped portion, said sensing means comprising a part carried by and rotatable with said drum, said part having a reflective surface, means for directing light at said reflective surface, adjusting means connected between one of said gripper jaws and said part for adjusting the position of said part so that light is reflected from said reflective surface when said clamped portion of said signature has a predetermined desired thickness, and means for sensing changes in the light reflected from said reflective surface.

6. A signature handling apparatus as defined in claim 5 further including a base nonrotatable with said drum, said light directing means and said light sensing means being mounted to said base, and a synchronizing means for activating said light sensing means only during a predetermined interval in each revolution of said drum.

7. A signature handling apparatus as defined in claim 6 wherein said synchronizing means comprises a cam mechanically connected with said rotatable drum, and a cam operated switch mounted on said base, said light sensor means being actuated only when said cam operated switch is closed, said cam having a lobe which operates to close said switch during a specific interval in each revolution of said rotatable drum.

8. A signature handling apparatus as defined in claim 7 wherein said reflective surface is arcuate having a center of curvature which coincides with the center of said rotatable drum when said part is in a predetermined position, said adjusting means between said part and one of said gripper jaws being adjustable such that said part is in said predetermined position when said gripper means properly clamps the signature.

9. A signature handling apparatus as defined in claim 5 further including a secondary reflective surface positioned intermediate to said reflective surface associated with said gripper and said light sensing means.

* * * * *